US007784708B2

(12) United States Patent
Guerbaoui et al.

(10) Patent No.: US 7,784,708 B2
(45) Date of Patent: Aug. 31, 2010

(54) FUEL INJECTING DEVICE AND METHOD FOR CONTROLLING SAID DEVICE

(75) Inventors: Samir Guerbaoui, Paris (FR); Andre Agneray, Boulogne (FR); Laurent Levin, Paris (FR)

(73) Assignee: RENAULT s.a.s., Boulogne Billancourt (FR)

( * ) Notice: Subject to any disclaimer, the term of this patent is extended or adjusted under 35 U.S.C. 154(b) by 0 days.

(21) Appl. No.: 11/997,648

(22) PCT Filed: Jul. 20, 2006

(86) PCT No.: PCT/FR2006/050740

§ 371 (c)(1),
(2), (4) Date: Jul. 21, 2008

(87) PCT Pub. No.: WO2007/015022

PCT Pub. Date: Feb. 8, 2007

(65) Prior Publication Data

US 2008/0315019 A1 Dec. 25, 2008

(30) Foreign Application Priority Data

Aug. 1, 2005 (FR) ..... 05 08182

(51) Int. Cl.
*B05B 17/04* (2006.01)

(52) U.S. Cl. ..... 239/4; 239/5; 239/102.2; 239/585.1; 239/533.2; 251/129.06

(58) Field of Classification Search ..... 239/102.2, 239/585.1, 533, 533.9, 4, 5
See application file for complete search history.

(56) References Cited

U.S. PATENT DOCUMENTS

| | | | | |
|---|---|---|---|---|
| 5,803,370 | A * | 9/1998 | Heinz et al. | 239/533.9 |
| 6,318,646 | B1 * | 11/2001 | Mattioli et al. | 239/585.1 |
| 6,543,700 | B2 * | 4/2003 | Jameson et al. | 239/102.1 |
| 7,021,569 | B1 * | 4/2006 | Ogura et al. | 239/585.4 |
| 2006/0278735 | A1 | 12/2006 | Agneray et al. | |

FOREIGN PATENT DOCUMENTS

| | | |
|---|---|---|
| DE | 33 14 899 | 10/1984 |
| EP | 1 045 135 | 10/2000 |
| EP | 1 382 838 | 1/2004 |
| FR | 2854664 | 11/2004 |
| WO | 03 031798 | 4/2003 |
| WO | 2004 101985 | 11/2004 |

OTHER PUBLICATIONS

U.S. Appl. No. 12/666,312, filed Dec. 23, 2009, Agneray, et al.

* cited by examiner

*Primary Examiner*—Dinh Q Nguyen
(74) *Attorney, Agent, or Firm*—Oblon, Spivak, McClelland, Maier & Neustadt, L.L.P.

(57) ABSTRACT

A fuel injecting device and method of controlling the fuel injection device. The fuel injection device includes a cylindrical body, a needle whose end includes with a head forming a valve on a seat supported by the end of the cylindrical body, an actuator made of an electroactive material, including a rod and that displaces the head such that the valve is opened, and a prestressing device holding the needle and a counterweight such that they are pressed against the rod opposite end. The needle extends coaxially to the cylindrical body in a form of a rigid bar and axially resonates when exposed to axial pulses at a determined excitation frequency by the actuator.

18 Claims, 1 Drawing Sheet

FUEL INJECTING DEVICE AND METHOD FOR CONTROLLING SAID DEVICE

BACKGROUND OF THE INVENTION

I. Field of the Invention

The invention relates to a fuel injection device, particularly for an internal combustion engine, and to the method of controlling it.

II. Description of Related Art

Document FR 2 854 664 discloses an injection device comprising a tubular body in which a needle is mounted. The needle ends in a head that acts as a valve with a seat borne by the end of the tubular body. Pressurized fuel is fed into the tubular body and is halted by the valve. The needle has a longitudinal housing in which an electroactive material is positioned. When the electroactive material is excited, it lengthens, causing elastic lengthening of the needle and thus detaching the head from the seat. The valve is then open and the fuel passes between the seat and the head to be injected into a combustion chamber.

With an injector such as this, the response time for obtaining maximum valve lift is very short, typically less than 50 μs. It is therefore possible to control the extent to which the valve opens practically at every instance during the injection period. The instantaneous delivery of fuel and the formation form droplets are thus controlled.

However, it is necessary for the electroactive element to be in close proximity to the head. Now, because of the proximity to the combustion chamber, the electroactive element may be raised to temperatures that could be detrimental to its operation. In addition, installing it close to the tip of the injector may present problems of availability of space.

BRIEF SUMMARY OF THE INVENTION

It is therefore an object of the invention to propose a fuel injection device in which the position of the valve head can be controlled precisely, with a good response time, and which the electroactive element can operate under acceptable conditions.

With this object in mind, a subject of the invention is a fuel injection device comprising a cylindrical body, a needle one end of which has a head acting as a valve on a seat borne by one end of the cylindrical body, an electroactive material actuator, the actuator comprising a rod and being able to cause the head to move in order to open the valve, a weight extending the rod, a preloading device keeping the needle and the weight pressed against opposite ends of the rod. The needle runs coaxially with respect to the cylindrical body in the form of a rigid bar, the needle being able to go into axial resonance when subjected by the actuator to axial impulses at a given excitation frequency, thus superimposing vibrational movement of the head on the overall movement of the needle.

The length of the bar allows the actuator to be positioned in the body of the device away from the head and therefore to be less exposed to the heat of the combustion chamber. The excitation frequency is chosen to be close to a natural frequency of the needle so as to obtain resonance through a succession of compressions and extensions of the needle in the axial direction. Furthermore, the fact that the bar can be set in resonance in the axial direction of the device makes it possible to obtain a head displacement mode in the axial direction at the chosen excitation frequency. The frequency chosen is, for example, such that the oscillation period is very much shorter than the duration of an injection phase or injection period. The oscillations of the head allow the fuel delivery to be altered and thus provide control over the formation of very fine droplets of fuel. These oscillations (arriving out of the vibratory movement) are superposed on the overall movement of the needle. The two actions occur simultaneously. When the rod deforms under the effect of a signal, it presses at one end against the needle and at the other end against the weight. The reaction of the weight against the rod allows an essential proportion of the movement of the bar to be transmitted to the needle.

By way of example, the excitation frequency lies in a range extending from 10 to 30 kHz. It is thus possible to obtain a formation of very fine droplets during the injection phase.

In a first embodiment, the rod is made of magnetostrictive material and is surrounded by a coil able to create a magnetic field in the rod. When a material such as this is subjected to a magnetic field it undergoes a lengthening which is transmitted to the needle. The needle therefore moves axially in the direction that opens the valve. Depending on the frequency of the magnetic field, the needle will move in its entirety, in the case of a low frequency, or will lengthen and contract in resonance if the magnetic field is at an excitation frequency able to put the needle into resonance, that is to say is at a frequency close to a natural frequency of the needle.

As a preference, a tube made of ferromagnetic material surrounds the coil. Thus, the magnetic field created in the rod is looped back on itself by virtue of the tube, thus increasing the effectiveness of the coil.

In a second embodiment, the rod is made of piezoelectric material.

As a preference, the impedance of the weight is greater than the impedance of the needle. The impedance is defined by the product of the density times the speed of sound in the material of which the weight is made. The impedance characterizes the dynamic behavior of the material. Because the impedance of the weight is greater, the movement caused is essentially passed on to the needle, in the form of a deformation or of a movement. Thus, even if the weight is not fixed to the body of the device, the assembly formed by the needle, the rod and the weight behaves, at the frequencies employed, as if the weight were fixed.

In particular, the preloading device comprises a tubular sleeve tube containing the weight and the actuator, a preloading spring pressing against the sleeve tube and tending to push the weight against the rod, and an elastic washer, the needle having a flange, the elastic washer bearing against the flange in order to compress the needle against the rod. The compressive preload on the rod increases the operational amplitude of the rod. In this configuration, applying the preload also allows the weight and the needle to be pressed against the rod. In addition, the movement of the end of the rod in contact with the needle is permitted through the elastic deformation of the washer.

In an improvement, the assembly comprising the needle, the preloading device and the actuator is mounted such that it can slide in the cylindrical body, there being pressing means acting on said assembly and tending to press the head against the seat. This setup makes it possible to compensate for differential expansions in the device and which are due to the differences in temperature of the components and in the expansion characteristics of each component. The injection periods for which the head of the needle is no longer pressed against the seat are short enough for the assembly comprising the needle, the preloading device and the actuator not to have time to move and close the valve again.

A further subject of the invention is a method of controlling an injection device as described hereinabove, whereby an injection phase is performed by applying to the actuator a continuous signal during the injection period and a periodic signal at an excitation frequency capable of causing the needle to go into resonance. The continuous signal has the effect of making the needle move in its entirety while the periodic signal has the effect of setting the needle in resonance. The amplitude of the movement of the needle and the amplitude of its oscillations can be modulated. The amplitude of these two signals can be modulated during an injection period.

According to an improvement, a damping signal obtained via the inverse transform of the simulated oscillatory movement of the head is superposed if the control signal is cut off. If the control signal is suddenly cut off, the head of the needle returns to its position against the seat at a high speed because of the superposition of the two signals, thus generating a shock. By simulating the way in which the head moves in the absence of the seat, it is possible to obtain an oscillatory movement about the rest position of the head. By applying an inverse transform to this oscillator movement a damping signal is obtained which, when applied to the control signal, makes it possible to obtain a damped movement of the head. The head then returns to its seat gently at the end of the injection period.

BRIEF DESCRIPTION OF THE DRAWINGS

The invention will be better understood and further features and advantages will become apparent from reading the description which will follow, the description making reference to FIG. 1, which is a view in longitudinal section of a device according to the invention.

DETAILED DESCRIPTION OF THE INVENTION

Figure 1:
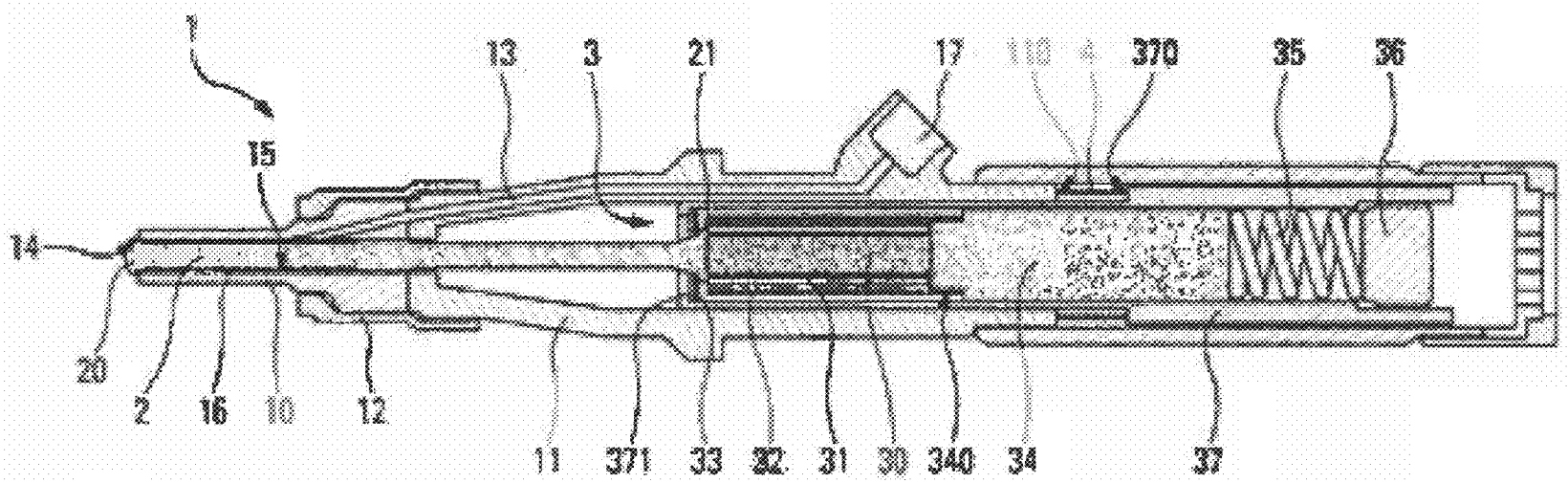

An injection device 1 according to the invention, shown in FIG. 1, is intended to inject fuel into a combustion chamber of an internal combustion engine or into an air intake pipe, neither of which items has been depicted.

The injection device comprises a cylindrical body made in two parts, a front part 10 and a rear part 11, which parts are coaxial and joined together by screw-fastening by way of a sleeve 12.

The front part 10 of the cylindrical body has a bore 15 coaxial with the cylindrical body and a seat 14 at one end of the front part 10. A needle 2 is slideably mounted in the bore 15. It comprises a head 20 which acts as a valve with the seat 14. A passage 16 is formed in a space between the bore 15 and the needle 2 to route fuel as far as the seat 14. The passage 16 is fed from a duct 13 running inside the cylindrical body from a connection port 17.

The rear part 11 of the cylindrical body comprises a tubular sleeve tube 37 mounted such that it can slide along the axis of the cylindrical body. The tubular sleeve tube 37 is forced rearward by a sleeve tube spring 4 bearing against a first shoulder 110 belonging to the cylindrical body and a second shoulder 370 belonging to the tubular sleeve tube 37.

At its opposite end to the head 20 the needle 2 has a flange 21 against which an elastic washer 33 rests. The elastic washer 33 is also pressed against a third shoulder 371 belonging to the tubular sleeve tube 37 in such a way as to transmit the tension of the sleeve tube spring 4 to the needle 2 via the elastic washer 33 and thus press the head 20 of the needle against the seat 14.

In the rearward continuation of the needle 2 the injection device 1 comprises an electroactive material actuator 3 and a weight 34. In the embodiment described, the actuator 3 comprises a rod 30 of magnetostrictive material surrounded by a coil 31 and by a tube 32 of ferromagnetic material. The rod 30, is made, for example, of Terfenol (registered trade name). The rod 30 is compressed by a preloading device comprising a preloading spring 35 pressing against a nipple 36 screwed into the sleeve tube 37 and tending to press the weight 34 against the rod 30. The tube 32 of ferromagnetic material is pushed onto a guide cylinder 340 produced at the end of the weight 34 at the same end as the rod 30.

The length of the needle 2 is determined, in conjunction with the material of which it is made, in such a way that the needle goes into resonance when subjected to axial oscillations at an excitation frequency in a range extending from 10 to 30 kHz. Resonance is obtained when the needle is subjected to stresses at a frequency close to a natural frequency of oscillation of the needle. If the needle is of length 1, then there are various natural frequencies fn such that $fn=(2n+1)C/(4\times 1)$ where n is a positive integer or zero, and C is the speed of sound in the material of which the needle is made.

The weight 34 is made of a material for which the impedance is greater than the impedance of the needle. The weight 34 is for example made of tungsten, while the needle 2 is made of steel or of titanium. The impedance is defined by the formula $Z=\rho C$, where r is the density in $kg\cdot m^{-3}$ and C is the speed of sound in the material in $m\cdot s^{-1}$. The impedance can also be expressed as $Z=\sqrt{\rho E}$ where E is the Young's modulus of material, in Pa. In the case of steel, Z is of the order of 40 000 000, for tungsten, Z is of the order of 88 000 000 and for titanium, Z is of the order of 22 000 000. The greater the amount by which the impedance of the weight exceeds that of the needle, the more of the movement of the rod will be transmitted by preference to the needle, thus increasing the effectiveness of the system.

When an injection phase is performed, a continuous signal and a periodic signal substantially at the chosen excitation frequency are applied to the actuator during the injection period. To do that, means, not depicted, are used to supply the coil 31 with a current carrying the continuous signal and the periodic signal. As a result, the rod 30 lengthens on average according to the strength of the continuous signal and periodically at the excitation frequency. Bearing in mind the different linear impedances, the rod 30 rests against the weight 34 and sets the needle 2 in motion and into oscillation. The movement imparted to the head 20 of the needle is, for example, an average displacement of 20 to 30 μm and oscillations of the order of 10 to 20 μm about this mean position.

The invention is not restricted to the embodiment described solely by way of example. The actuator may be produced using a rod made of piezoelectric material.

The invention claimed is:

1. A fuel injection device, comprising:

a cylindrical body including a front part and a rear part;

a sleeve configured to fasten the front part to the rear part of the cylindrical body;

a needle with a first end including a head acting as a valve on a seat borne by the front part of the cylindrical body;

an electroactive material actuator comprising a rod and configured to cause the head to move to open the valve, the actuator being positioned in the rear part of the cylindrical body;

a weight extending from the rod; and a preloading device to keep the needle and the weight pressed against opposite ends of the rod;

wherein the needle runs coaxially with respect to the cylindrical body in a form of a bar, the needle configured to go into axial resonance when subjected by the actuator to axial impulses at a given excitation frequency, thus superimposing vibrational movement of the head on an overall movement of the needle.

2. The injection device as claimed in claim 1, wherein the excitation frequency is in a range from 10 to 30 kHz.

3. The injection device as claimed in claim 1, wherein the rod is made of magnetostrictive material and is surrounded by a coil configured to create a magnetic field in the rod.

4. The injection device as claimed in claim 3, further comprising a tube made of ferromagnetic material that surrounds the coil.

5. The injection device as claimed in claim 1, wherein the rod is made of piezoelectric material.

6. The injection device as claimed in claim 1, wherein impedance of the weight is greater than impedance of the needle.

7. The injection device as claimed in claim 1, wherein the preloading device comprises a tubular sleeve tube containing the weight and the actuator, a preloading spring pressing against the sleeve tube and tending to push the weight against the rod, and an elastic washer positioned between the needle and the actuator, and a second end of the needle including includes a flange, the elastic washer bearing against the flange to compress the second end of the needle against the rod of the actuator.

8. The injection device as claimed in claim 7, wherein an assembly comprising the needle, the preloading device, and the actuator is mounted to slide in the cylindrical body, and further comprising pressing means acting on the assembly and tending to press the head against the seat.

9. A method of controlling an injection device including a cylindrical body including a front part and a rear part; a sleeve configured to fasten the front part to the rear part of the cylindrical body; a needle with a first end including a head acting as a valve on a seat borne by the front part of the cylindrical body; an electroactive material actuator comprising a rod and configured to cause the head to move to open the valve, the actuator being positioned in the rear part of the cylindrical body; a weight extending from the rod; and a preloading device to keep the needle and the weight pressed against opposite ends of the rod, the method comprising:

applying to the actuator positioned in the rear part of the cylindrical body a control signal including a continuous signal to open the valve during an injection period and a periodic signal at an excitation frequency capable of causing the needle to go into resonance to superimpose vibrational movement of the head on an overall movement of the needle.

10. The control method as claimed in claim 9, wherein a damping signal obtained via inverse transform of simulated oscillatory movement of the head is superposed if the control signal is cut off.

11. The injection device as claimed in claim 1, wherein the weight is made of tungsten.

12. The injection device as claimed in claim 1, wherein the needle is made of steel or titanium.

13. The injection device as claimed in claim 4, wherein an end of the weight includes a guide cylinder and an end of the tube made of ferromagnetic material surrounds the guide cylinder.

14. The control method as claimed in claim 9, wherein the excitation frequency is in a range from 10 to 30 kHz.

15. The injection device as claimed in claim 1, wherein the actuator is positioned in the rear part of the cylindrical body such that the sleeve does not overlap the actuator in a radial direction.

16. The injection device as claimed in claim 1, wherein the sleeve is screwed on to the cylindrical body to join the front part and the rear part together.

17. The control method as claimed in claim 9, wherein the actuator is positioned in the rear part of the cylindrical body such that the sleeve does not overlap the actuator in a radial direction.

18. The control method as claimed in claim 9, wherein the sleeve is screwed on to the cylindrical body to join the front part and the rear part together.

* * * * *